US005197903A

United States Patent [19]

Casey et al.

[11] Patent Number: 5,197,903

[45] Date of Patent: Mar. 30, 1993

[54] FIREWALL CONNECTOR

[75] Inventors: Daniel T. Casey, Harrisburg; William T. Glenwright, York; Eric T. Green, Hummelstown, all of Pa.

[73] Assignee: AMP Incorporated, Harrisburg, Pa.

[21] Appl. No.: 840,801

[22] Filed: Mar. 2, 1992

[51] Int. Cl.[5] ..... H01R 9/24; H01R 13/74

[52] U.S. Cl. ..... 439/564; 439/712; 439/722

[58] Field of Search ..... 439/709, 564, 565, 566, 439/722, 712, 724; 174/84 S, 48

[56] References Cited

U.S. PATENT DOCUMENTS

| | | | |
|---|---|---|---|
| 2,545,429 | 3/1951 | Macy | 439/712 |
| 3,955,044 | 5/1976 | Hoffman et al. | 174/84 C |
| 3,995,102 | 11/1976 | Kohaut | 174/48 |
| 4,099,202 | 7/1978 | Kohaut | 174/48 |
| 4,336,416 | 6/1982 | Goodsell | 174/48 |
| 4,439,965 | 4/1984 | Langenhorst | 52/211 |
| 4,464,006 | 8/1984 | Wilt | 439/544 |
| 4,770,643 | 9/1988 | Castellani et al. | 439/135 |
| 5,032,690 | 7/1991 | Bloom | 174/48 |

OTHER PUBLICATIONS

Product of Flight Corp., Selelock Connector.

Product of ITT Cannon Corp., Part No. 8848-14 FRF6E36-5301; Fountain View, Calif.

*Primary Examiner*—Gary F. Paumen

*Attorney, Agent, or Firm*—Anton P. Ness

[57] ABSTRACT

A bulkhead connector (100,200) includes an array of bus bars (150,250) extending from a first face to a second face for interconnecting associated power cables (20,30) on opposing sides of the bulkhead (10). Embedded within the connector is a substrate (b 130,230) of fire resistant material extending transversely completely across the bulkhead opening (12), with apertures (144,244) through which extend the bus bars. Exposed contact sections (152,154;252,254) of the bus bars permit terminals (24,34) to be fastened thereto, and the connector is adapted to prevent rotation of the fastened terminals during in-service use.

20 Claims, 13 Drawing Sheets

FIREWALL CONNECTOR

FIELD OF THE INVENTION

This relates to the field of electrical connectors and more particularly to bulkhead connectors for interconnecting power cables in high temperature environments.

BACKGROUND OF THE INVENTION

Electrical power cables conventionally extend from generators powered by engines of jet aircraft to the main frame of the aircraft through the wing structure, extending through openings in the bulkheads adjacent the engines and generators. Such power cables transmit a current of up to 360 amperes at 115 volts, and have been continuous from the generator to the fuselage wall; in such arrangements, the entire cable length must be replaced when repair is needed, necessitating the tedious time-consuming unfastening of the cable from holders closely spaced along its length. The bulkhead is of rugged durable metal sufficient to withstand the very high temperatures associated with the jet engine vicinity; such temperatures may reach up to 550° F. In the case of a calamity, the bulkhead is also able to resist fire burnthrough should fire occur in the engine vicinity, providing a substantial safety benefit for the aircraft for a period of time. The cable openings through the bulkhead have conventionally been filled by fire-resistant rubber compressed within a cylindrical metal flange about the cables between steel plates joined by a stud, providing a complete barrier after the cables have been extended through the opening and along the wing to the fuselage.

It is desired to provide an arrangement whereby instead of use of a continuous cable, a pair of cable lengths is utilized having terminals on adjacent ends to be interconnected proximate the generator.

It is desired to provide an electrical connector providing for an electrical interconnection of the terminals which is disconnectable if desired. It is known in general to provide a post onto which terminals having ring-shaped contact sections both are placed and pressed together to define a compression fit suitable to define an assured electrical connection therebetween for transmitting power levels of current along the cable pair.

It is desired to provide such an electrical connector which is adapted for high temperature environments and is also adapted to provide for the substantial levels of compression of a ring-shaped contact section of a cable terminal to an interconnection bus.

It is further desired to provide such a connector which is mountable within the opening of a bulkhead.

It is additionally desired to provide such an electrical connector which is capable of withstanding flame burnthrough of the bulkhead opening within which it is mounted.

SUMMARY OF THE INVENTION

The present invention is a connector defining an impervious flame barrier and is mountable to a bulkhead opening. The connector includes a plurality of bus bars extending from first ends at a first mating face proximate the generator and engine on one side of the bulkhead, to second ends at a second mating face proximate the main frame or fuselage of the aircraft on the other side of the bulkhead. The first and second bus bar ends are adapted to have ring-tongue terminals of the power cables secured thereto by bolts extending through the bus bar ends and threadedly received into female inserts contained within the connector housing beneath the exposed bus bar ends. Embedded within the dielectric housing is a transverse substrate of very high temperature resistant plastic or of metal, which substrate is shaped and dimensioned to provide effective closure of the bulkhead opening. The substrate includes openings through which extend the bus bars, with the openings shaped and dimensioned to be slightly larger than the bus bar cross-section to compensate for differences in thermal expansion coefficients of the diverse materials of the substrate and the substantially high copper content metal of the bus bars. Mounting accessories secure the connector to the periphery about the bulkhead opening, with the embedded substrate abutting the opening periphery. The connector also provides inserts within the connector housing adjacent the first and second contact sections of the bus bars, having threaded openings aligned with bolt-receiving apertures of the contact sections, enabling bolts to be threaded thereinto for electrically connecting ring-tongue terminals of the power cables to the contact sections under appropriate compressive force.

In one embodiment of the invention, the connector housing is molded around the substrate and mounting accessories and bus bars held by the mold apparatus, such as in a conventional insert molding operation, with the housing having two portions secured on the two major surfaces of the substrate. A first one of the two housing portions is molded to the bulkhead proximate surface of the substrate and has an outer envelope smaller than the bulkhead opening enabling it to be inserted through the bulkhead opening from the engine side of the bulkhead. The second housing portion of the engine side is molded to the bulkhead remote surface of the substrate and extends around a continuously flanged side edge of the substrate. Housing apertures are molded in the second housing portion aligned with apertures through the substrate aligned with mounting apertures through the bulkhead, for mounting bolts to be inserted therethrough to secure the connector to the bulkhead, with the housing apertures large enough for the bolt head to be received completely therewithin to abut the bulkhead remote surface of the substrate upon completion of the mounting procedure.

In another embodiment, the connector housing is molded to one side of the substrate and extending around a continuously flanged side edge thereof, with the bus bars extending outwardly of the substrate enabling mounting of the connector to the fuselage side of the bulkhead, and with heads of the mounting bolts integrally molded within the housing along the bulkhead remote surface of the substrate and threaded shanks of the bolts extending through and beyond the bulkhead proximate surface of the substrate and corresponding with mounting apertures through the bulkhead. A second housing member is fabricated having a body section with axially extending passageways which are adapted to receive the exposed bus bar portions therethrough for the bus bar ends to be exposed along the mating face of the housing member for the terminals of the engine side cables to be bolted thereto. Female inserts are disposed in corresponding apertures transverse of the bus bar passageways and secured against rotation, for the terminal bolts inserted through holes of the bus bar ends to be threaded thereinto for electrically connecting the ring-torque terminals to the ends of the respective bus bars. The second housing member includes a peripheral mounting flange extending laterally from the body section to abut the bulkhead surface about the opening, containing a seal member in a groove to seal against the bulkhead; the flange contains metal bushings molded therein defining openings corresponding with mounting apertures of the bulkhead, for bolt shanks extending from the first housing on the ship side through corresponding bulkhead mounting apertures to be inserted into the second housing through the bushing for nuts to be secured thereon for connector mounting; the bushings enable the bolt/nut assemblies to remain firmly in position should the housing disintegrate or be incinerated during a calamity, holding the substrate across the bulkhead opening and maintaining the integrity of the flame-resistant closure established by the substrate for at least a period of time should fire occur in the engine.

It is an objective of the present invention to provide an electrical connector mountable to a bulkhead at an opening therethrough, having bus bars enabling connection at terminals of power cables to be interconnected to be fastened and connected to respective ends of the bus bars on respective sides of the bulkhead.

It is another objective to provide such a connector which is adapted for use in high temperature environments.

It is a further objective for such a connector to provide a means to remain secured to the bulkhead and close the opening to withstand flame burnthrough for at least a substantial length of time in the event of a calamity, even though the housing proper disintegrates or is incinerated.

Embodiments of the present invention will now be described by way of example with reference to the accompanying drawings.

BRIEF DESCRIPTION OF THE DRAWINGS

FIGS. 13 and 14 are shipside and engine side isometric views respectively of the component portions of the connector of FIG. 12 positioned as if to be mounted to a bulkhead and thus become assembled, with a female insert to be inserted into one of the housing members;

DETAILED DESCRIPTION OF THE PREFERRED EMBODIMENTS

Figure 1:
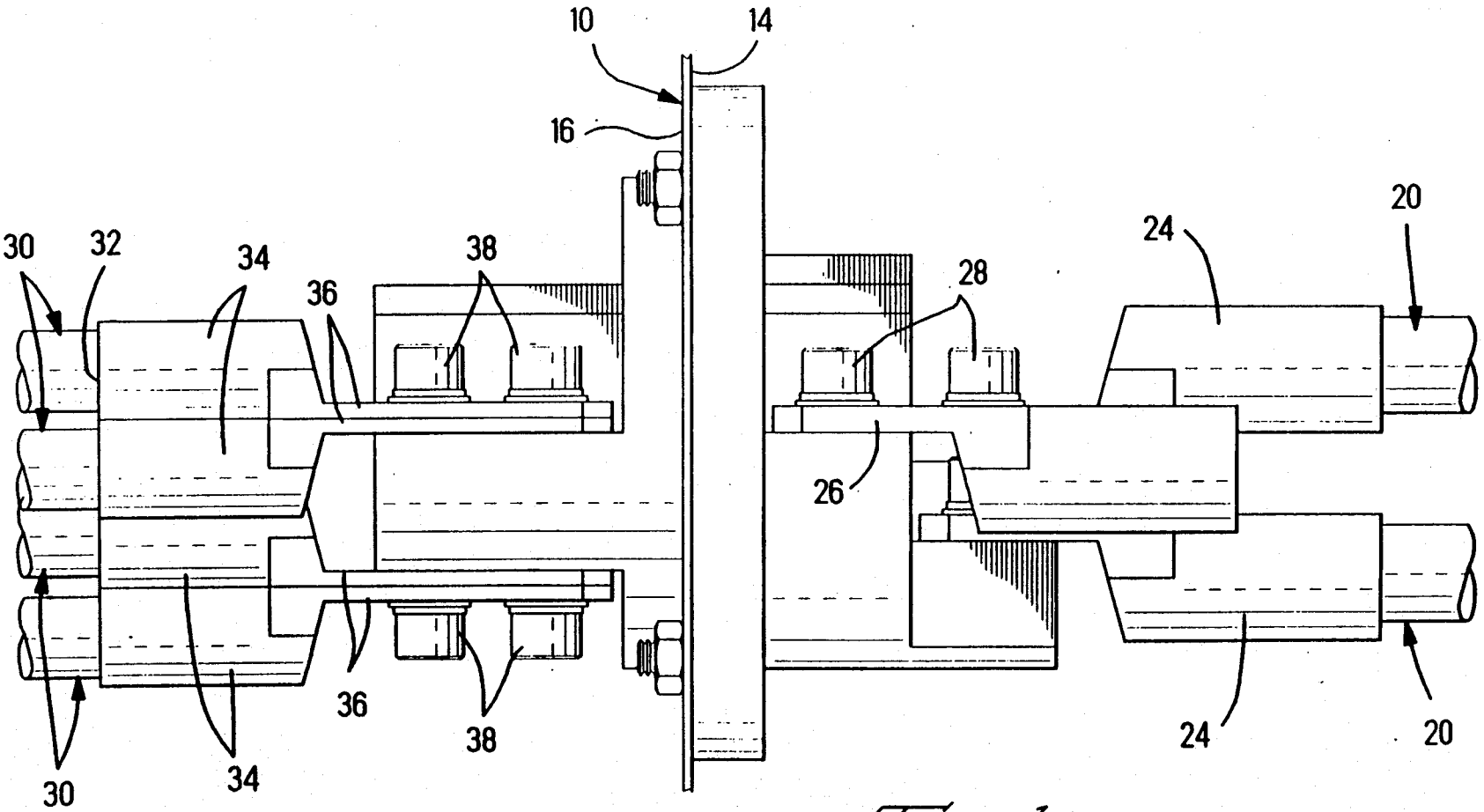
FIG. 1 is an elevation view of the connector of a first embodiment mounted to a bulkhead of an aircraft, with power cables terminated thereto at several of the termination sites.

A first embodiment of firewall connector 100 of the present invention is illustrated in FIGS. 1 to 11, adapted to be mounted to a bulkhead opening 12 from the engine side of the bulkhead 10, while a second embodiment of the connector 200 is shown in FIGS. 12 to 18. Throughout the drawings, the engine side of the bulkhead will be toward the right (surface 14) and the ship side toward the left (surface 16). Both connectors 100,200 upon being fully mounted present exposed bus bar contact sections of a plurality of bus bars for interconnecting ends 22,32 of shipside and engine side power cables 20,30 shown having terminals 24,34 having apertured tongue contact sections 26,36 terminated thereto by bolt fasteners 28,38; on the ship side are shown terminals 34 terminated in pairs and thus commoned to a respective bus bar, for connecting a pair of cables simultaneously to a single bus bar, if desired.

In FIGS. 1 to 11 connector 100 is adapted to be inserted into and through bulkhead opening 12 from the engine side, to be mounted against bulkhead surface 14. Outer housing 102 is shown having a first housing portion 104 joined to a transverse mounting portion 106, all to extend from the engine side of bulkhead 10, and a second housing portion 108 to extend through opening 12 and outwardly from the bulkhead on the shipboard side. mounting portion 106 includes an array of mounting apertures 110 through which are inserted mounting bolts 180 having threaded shank portions 182 extending from heads 184. Nuts 186 are used on the shipboard side of bulkhead 10 to complete the mounting, and nuts 186 may be bonded to bulkhead surface 16 at mounting openings 18 prior to connector mounting, if desired, to assist assembly. Second housing portion 108 is shaped and dimensioned to just fit through bulkhead opening 12, which is shown to be round.

Bus bars 150 extend through connector housing 102 and include first contact sections 152 at first ends thereof and second contact sections 154 at second ends thereof, all exposed to receive terminal tongues 26,36 fastened thereto for electrical connection by bolts 28,38 inserted through apertures 156,158 as in FIG. 1. First and second contact sections 152,154 are preferably disposed along channels 112,114 of the first and second housing portions 104,106. To facilitate fastening of tongues 26 to first contact sections 152, a vertical wall surface 116 is formed by the housing along at least one side of each channel 112 to prevent rotation of terminal 34 after termination due to substantial stress and torque on cables 20 which could otherwise tend to loosen the terminations.

Figure 3:
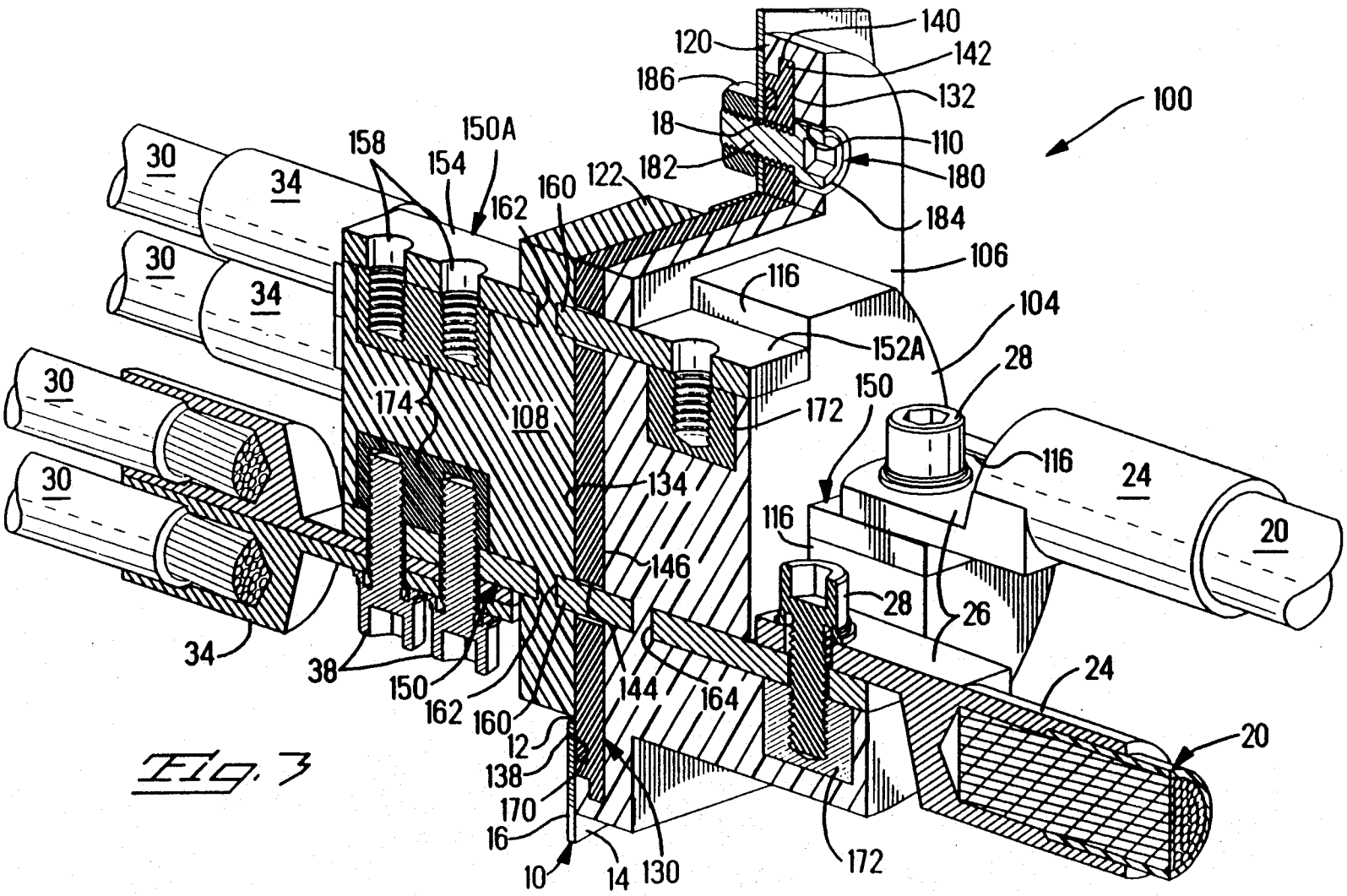
FIG. 3 is a partially sectioned view of the connector of FIG. 1 showing the bus bars and fire-resistant substrate embedded within the housing of the connector, with terminated power cables fastened to selected bus bar contact sections.

Referring to FIG. 3, the present invention includes a substrate 130 embedded within housing 102. Substrate 130 defines a transverse member which traverses bulkhead opening 12 and is composed of especially flame resistant material such as sintered polybenzimidazole resin. A flange portion 132 extends transversely beyond the periphery of bulkhead aperture 12 to coextend along engine side surface 14 of bulkhead 10; flange portion 132 defines a bulkhead proximate surface 134 which abuts bulkhead 10 upon full mounting. Mounting apertures 136 extend through flange portion 132 for receipt of shanks 182 of mounting bolts 180 therethrough; mounting apertures 110 of housing 102 are dimensioned large enough for bolt heads 184 to be received thereinto to abut substrate 130 about the periphery of mounting apertures 136 when fully fastened A groove 138 is defined in bulkhead proximate surface 134 near outer edge 140 of substrate 130, in which is secured a seal member 170 to establish a seal against bulkhead 10 upon full connector mounting. Mounting flange 108 of housing 02 includes a peripheral portion 120 surrounding lip 42 around outer edge 140 of substrate 130.

Bus bars 150 include body sections 160 extending through housing 102 from first contact sections 152 to second contact sections 154 and extend through bar-receiving apertures 144 of substrate 130. Second contact sections 154 are shown having a pair of bolt-receiving holes 158 for two bolts 38 providing not only redundancy in terminal fastening but also act to prevent rotation of terminals 36 after assembly due to substantial stress and torque on cables 30 which could otherwise tend to loosen the termination. Also seen in FIG. 3 are female inserts 172 contained in first housing portion 104 beneath channels 112 and first bus bar contact sections 152, and female inserts 174 contained in second housing portion 108 beneath channels 114 and second contact sections 154, containing threaded bores to receive threaded ends of bolts 28,38 respectively.

Figure 4:
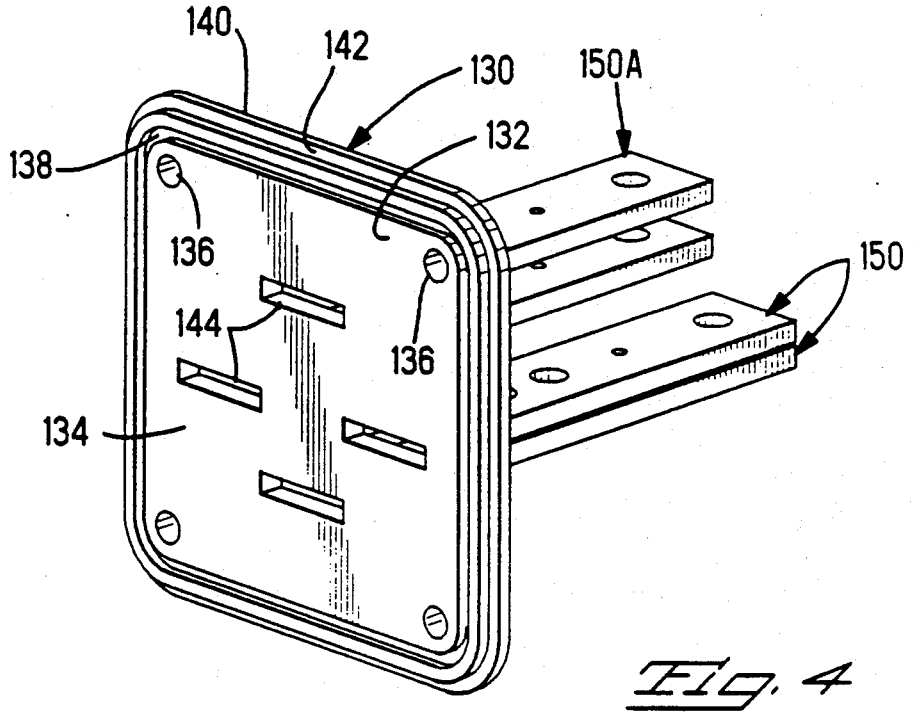
FIGS. 4 to 8 are isometric views of the connector being fabricated, with FIGS. 4 and 5 showing the embedded substrate and the bus bars before and after being inserted through respective openings and female inserts attached, FIGS. 6 and 7 showing the connector from the ship side and the engine side respectively after molding the second housing portion to the ship side of the substrate, and FIG. 8 showing the connector after molding the first housing portion to the engine side.
Figure 5:
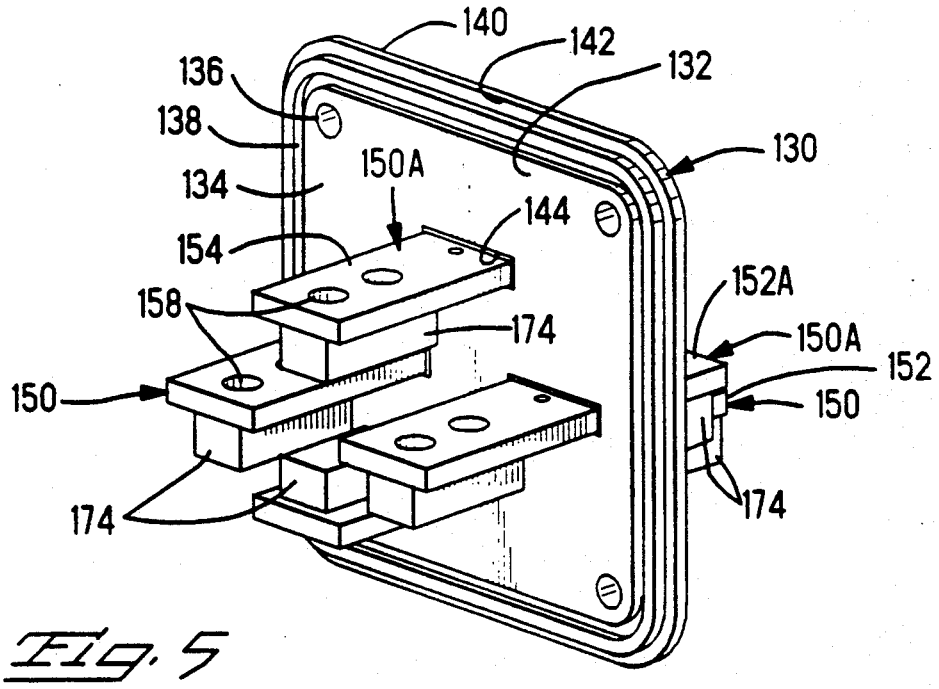

FIGS. 4 to 8 illustrate the steps in fabrication of connector 100. In FIGS. 4 and 5 the elongate bus bars 150 have a regular rectangular cross-section therealong, and are inserted through correspondingly shaped bar-receiving apertures 144 of substrate 130 which are just slightly larger than the bus bar cross-section to allow for expansion of the bus bars at elevated in-service temperatures; two bus bars 150A are shown shorter than the other bus bars 150, for first contact sections 152A thereof not to extend as far outwardly as first contact sections 152, thus enabling staggered fastening of terminals of the cables from a common direction and also enabling right angled cable attachments (see FIG. 12).

Figure 6:
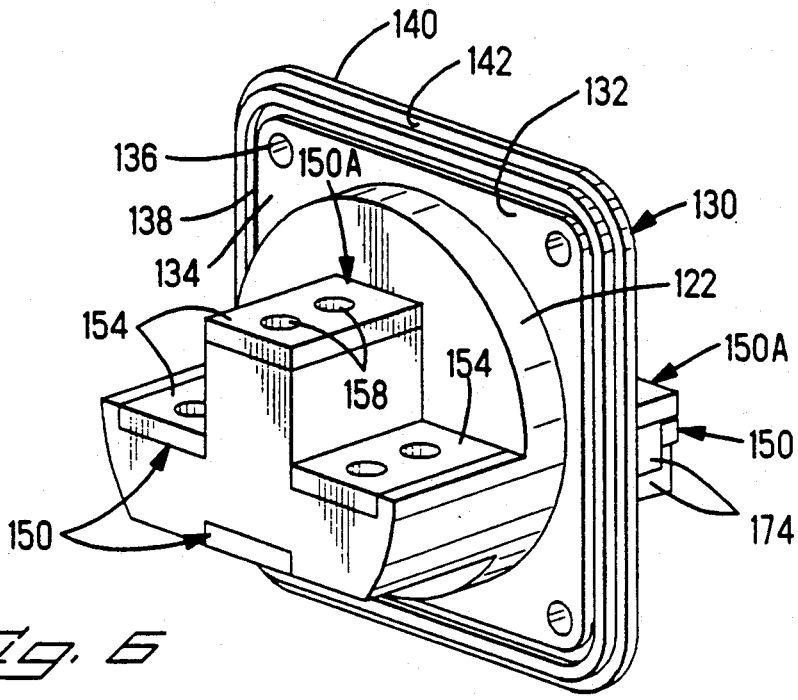
Figure 7:
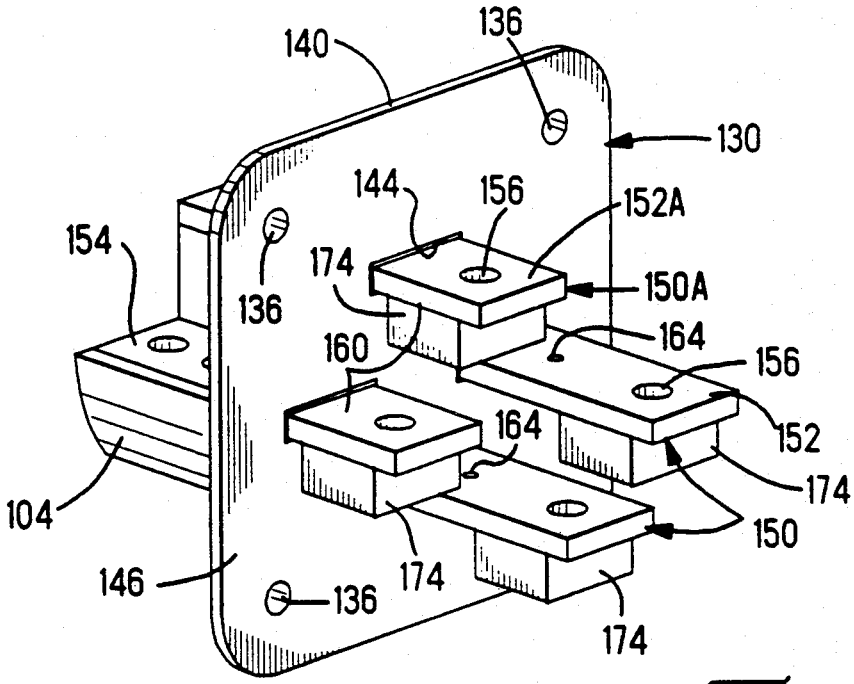

In FIG. 6 the second housing portion 108 is molded along bulkhead proximate surface 134 of substrate 130 embedding the portions of bus bar body sections extending through bar-receiving apertures 144; conventional insert molding procedures may be followed to hold female inserts 174, bus bars 150 and substrate 130 positioned within the mold cavity while the resin is injection molded therearound. Female inserts 174 may be temporarily affixed to bus bars 150,150A by welding or brazing after insertion through bar-receiving apertures 144, to facilitate holding during molding, if desired. Body sections 160 of bus bars 150 include holes 162 therethrough through which resin extends to provide a mechanical joint of second housing portion 108 to bus bars 150 (see FIG. 3). FIG. 7 illustrates the engine side view of connector 100 after molding second housing portion 108 thereto, with bulkhead remote surface 146 of substrate 130 exposed and first ends of bus bars 150,150A extending therefrom; holes 164 are seen through body sections 160 of the bus bars.

Figure 2:
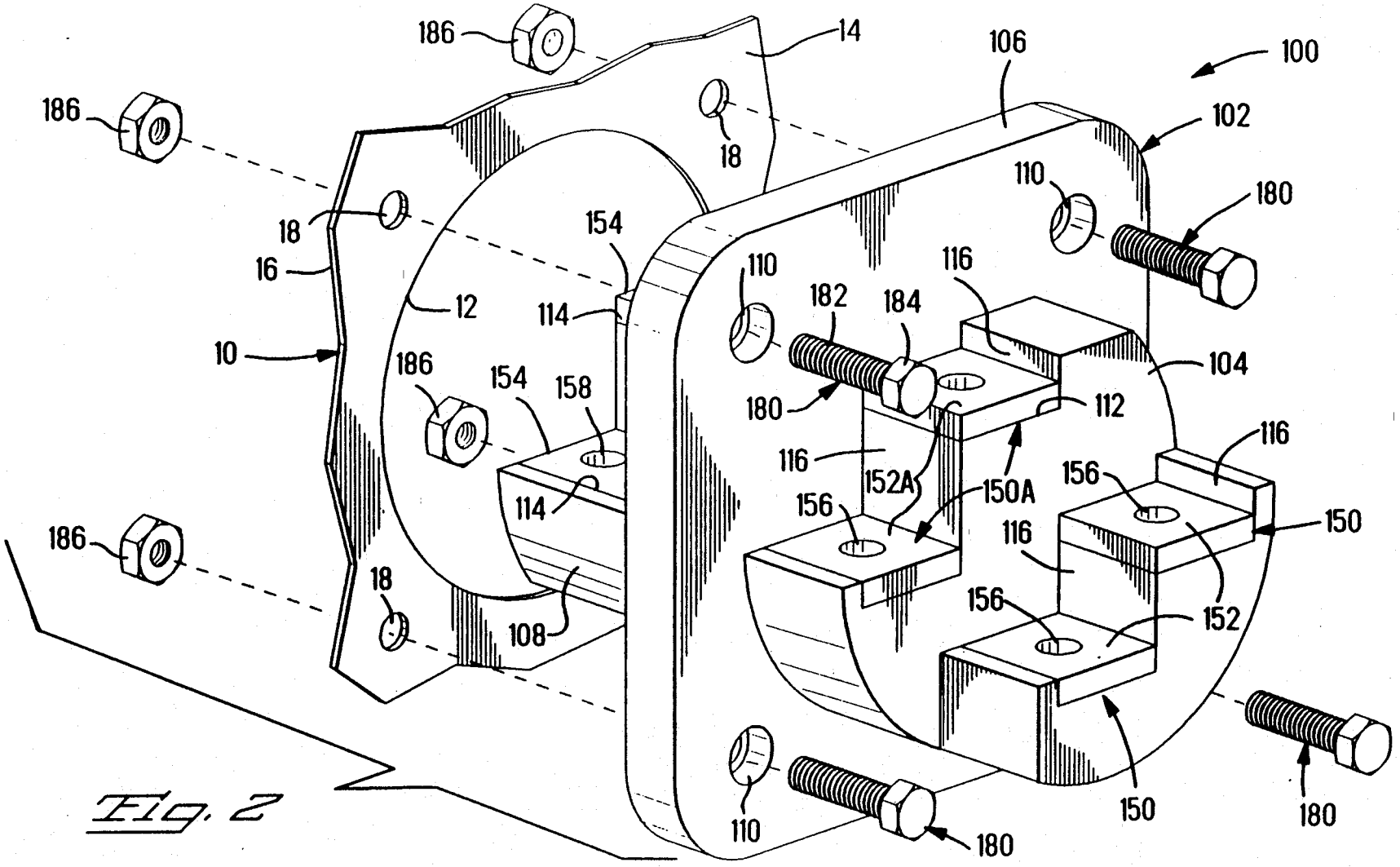
FIG. 2 is an isometric view of the connector of FIG. 1 positioned to be mounted to the bulkhead at an opening therethrough from the engine side of the bulkhead.
Figure 8:
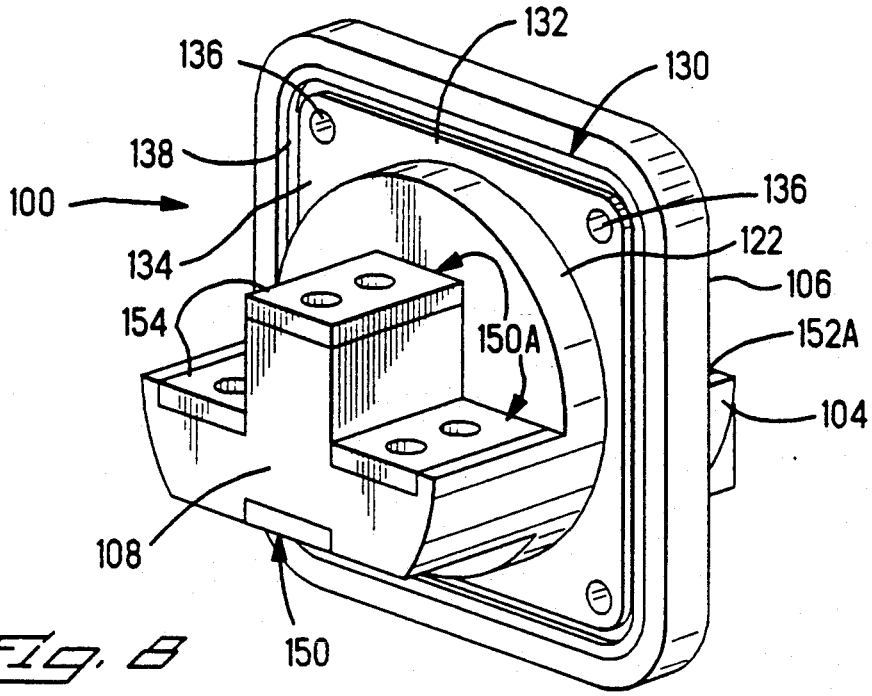

FIG. 8 illustrates connector 100 from the ship side after molding of first housing portion 104 to bulkhead remote surface 146 of substrate 130, showing peripheral portion 120 outwardly of peripheral edge 140 of substrate 130; the engine side view of connector 100 after molding first housing portion 104 thereto may be seen in FIG. 2. Second housing portion 108 includes a substrate adjacent portion 122 dimensioned and shaped to just fit through the bulkhead opening. Bulkhead proximate surface 134 of substrate 130 at transverse flange portion 132 is seen exposed to abut bulkhead 10 upon mounting, with groove 138 yet to receive a bead of sealing material dispensed thereinto in sufficient quantity to extend outwardly of the bulkhead proximate surface to be later engaged and compressed by the bulkhead surface upon connector mounting. Such sealant material could be an RTV silicone elastomer, such as FORM-A-GASKET (trademark of Loctite Corp., Cleveland, Oh.). Female inserts 172 are embedded beneath first contact sections 152,152A in similar fashion to female inserts 174 of second housing portion 108, and resin extends through holes 164 of bus bars 150,150A to mechanically secure first housing portion 104 thereto to complete fabrication of connector 100.

Figure 9:
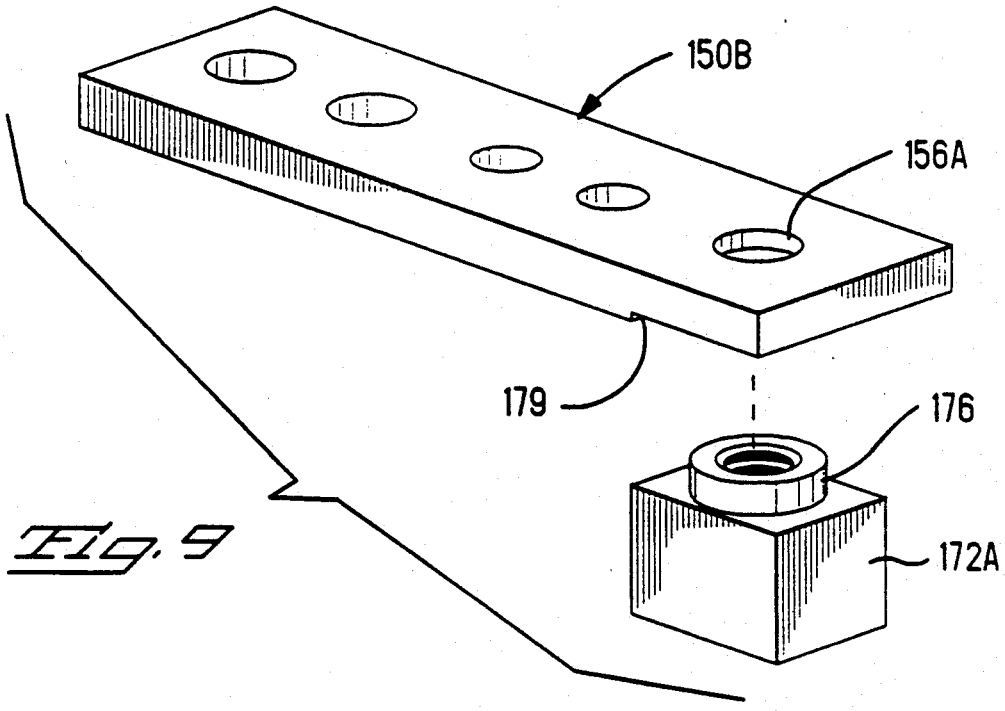
FIGS. 9 to 11 illustrate an alternate method of securing a female insert directly to a bus bar prior to connector fabrication, with the female insert being force fit into a countersunk hole beneath the contact section of the bus bar.
Figure 10:
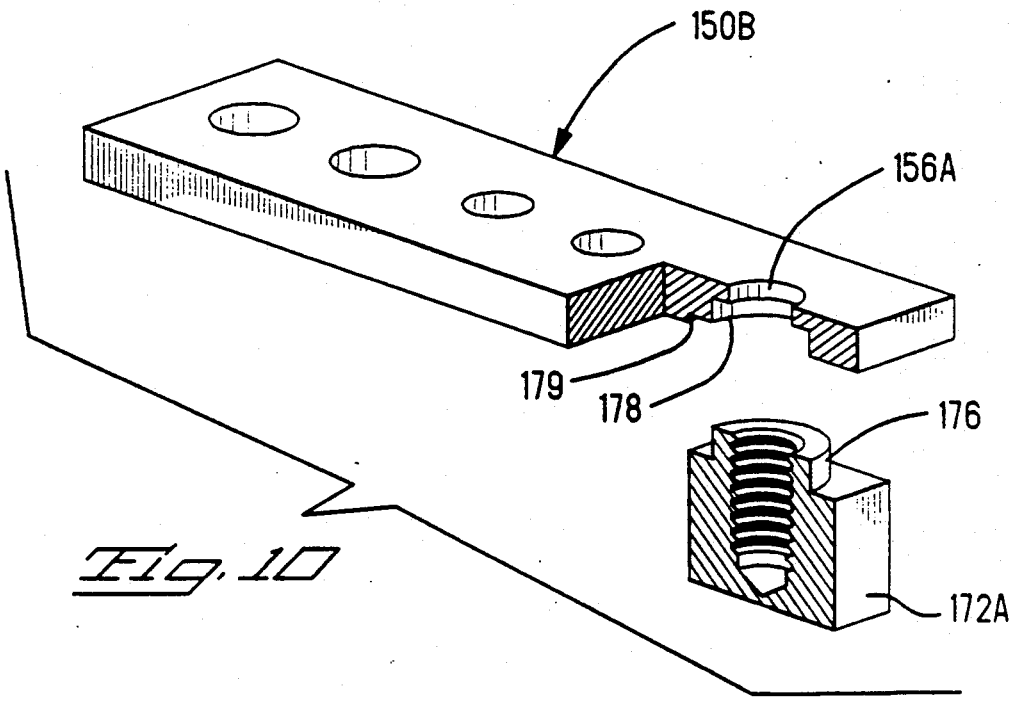
Figure 11:
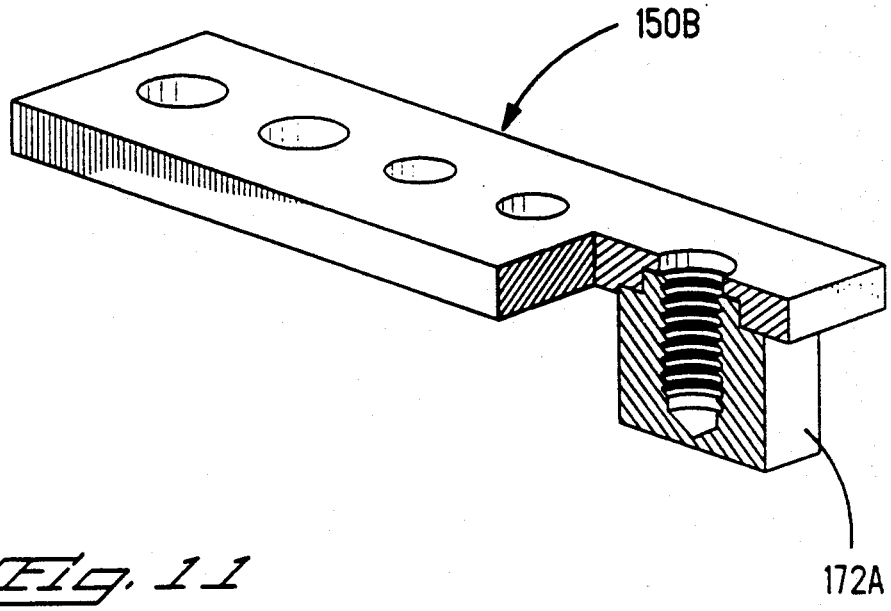

FIGS. 9 to 11 show an optional alternate method of securing a female insert to a bus bar: with an annular collar 176 extending from insert 172A having a selected outer diameter, and providing a counterbore 178 for bolt receiving aperture 156A of bus bar 150B extending into the terminal remote surface of the end of the bus bar, where counterbore 178 has an inner diameter incrementally less than the selected outer diameter of annular collar 176 and annular collar 176 may be force fit into counterbore 178. Preferably a transverse undercut 179 of the bus bar is used to assure prevention of rotation of female insert 172A after the terminals are secured to the bus bar contact section. Such an undercut may also be useful during a process of welding or brazing the female inserts to the bus bar, as a registration means.

Figure 12:
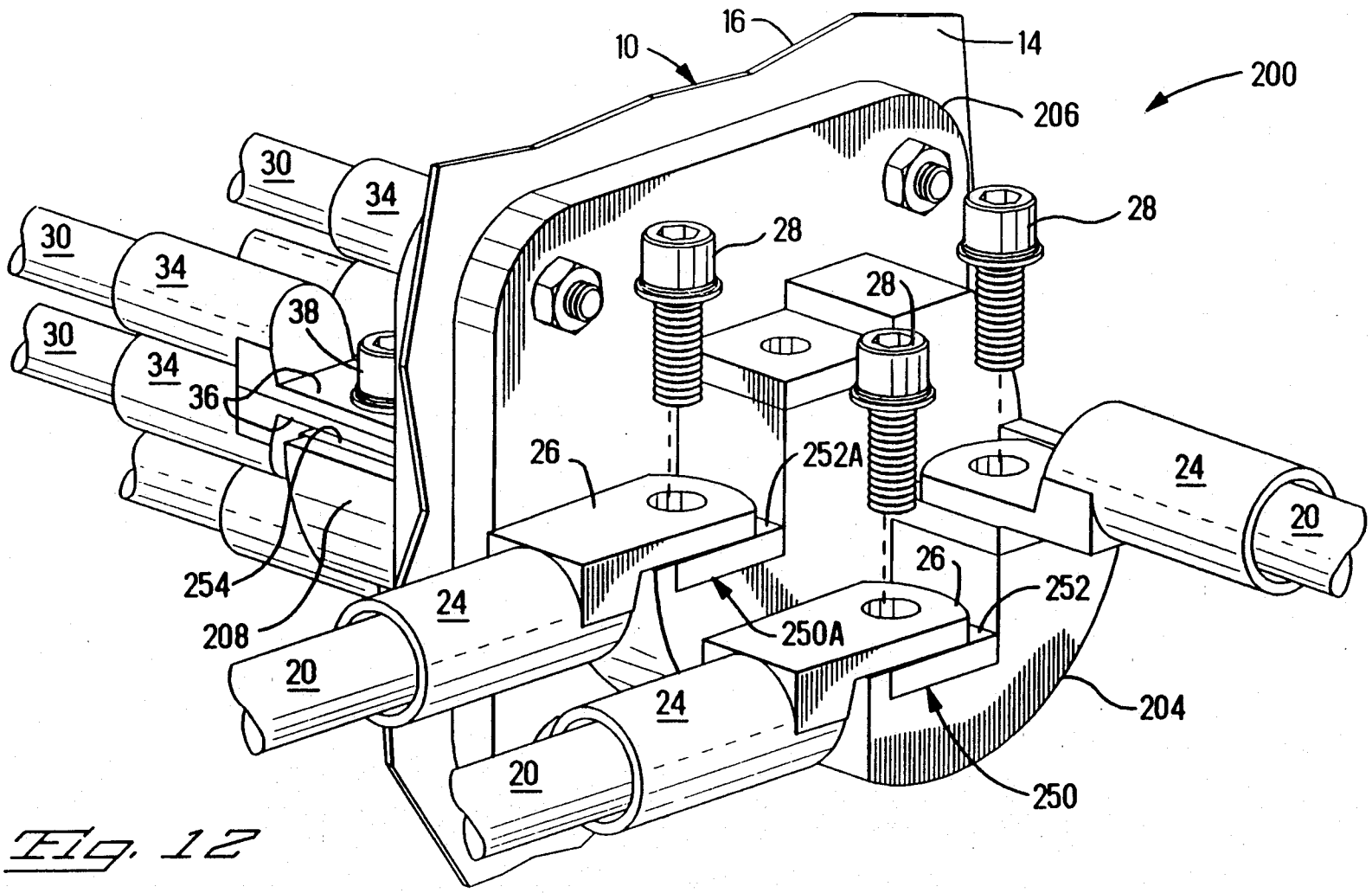
FIG. 12 is an isometric view of the connector of a second embodiment mounted to a bulkhead by shipside mounting, with terminated cable ends being fastened to bus bar ends to establish an electrical connection, with selected cable ends shown extending at right angles from the bus bars.

Connector 200 of FIGS. 12 to 18 is adapted to be mounted to bulkhead 10 from the ship side, and is shown fully mounted in FIG. 12. The connector presents contact sections on the engine side of bulkhead 10 which enable fastening of terminals 24 to extend parallel to the bulkhead in one direction, or perpendicular as desired, and the connector is thus seen as adapted to provide for either type at any selected termination site.

Figure 14:
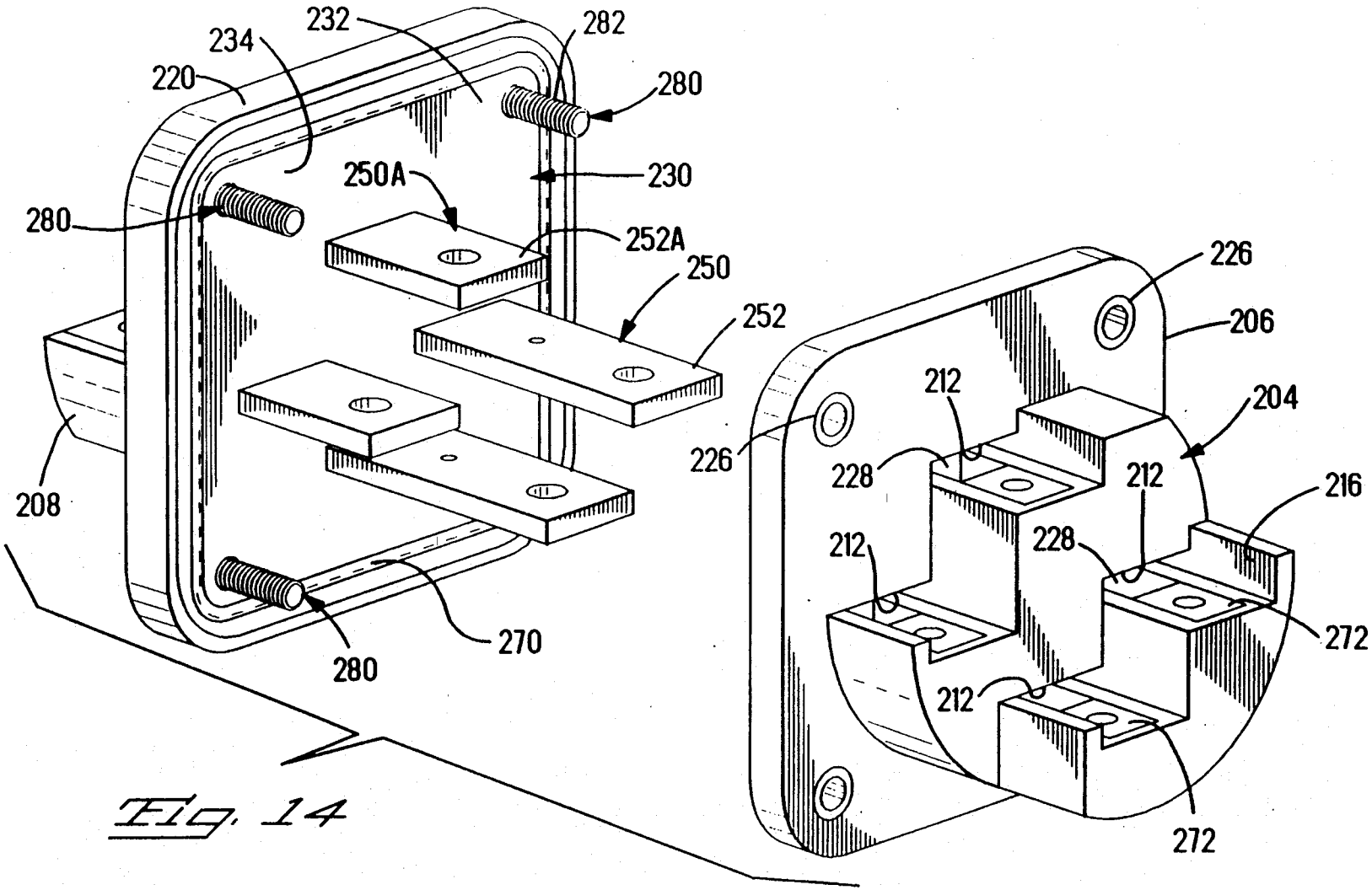

In FIGS. 13 and 14, first housing portion 204 is seen as having been fabricated as a separate member, while second housing portion 208 is molded about substrate 230 similarly to first housing portion 104 of connector 100. First housing member 204 is assembled to bulkhead 10 along engine side surface 14 thereof simultaneously with second housing portion 208 along shipside surface 16, after being placed over the ends of bus bars 250,250A extending through bulkhead opening 12 from bar-receiving apertures 244 at bulkhead proximate surface 234 of substrate 230. First ends of bus bars 250,250A are received through passageways 212 and along a vertical surface 216 similar to surfaces 116 of connector 100.

Figure 15:
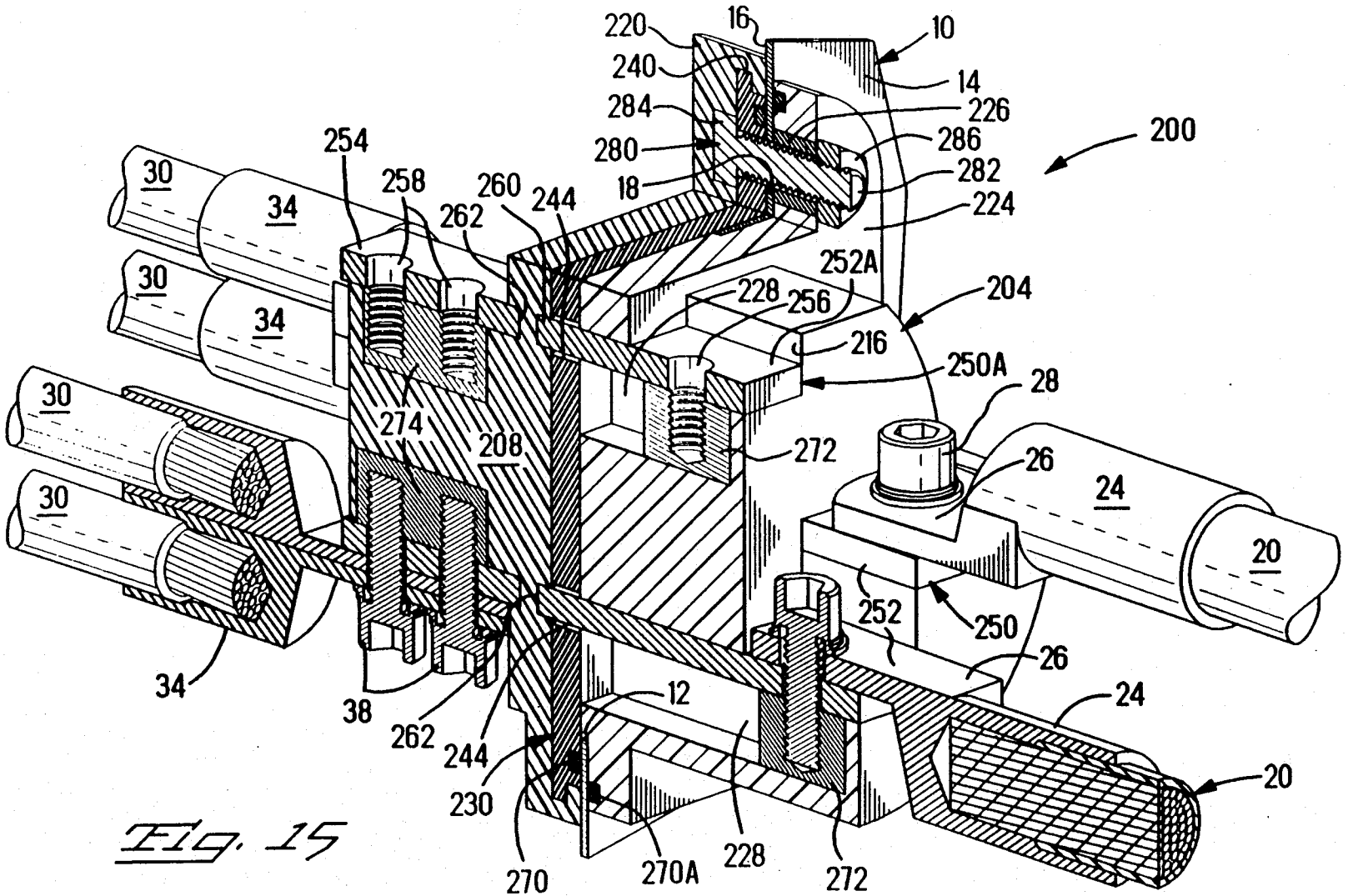
FIG. 15 is a partially sectioned view of the connector of FIG. 12 showing the bus bars, mounting accessories and fire-resistant substrate embedded within the housing of the connector, with terminated power cables fastened to selected bus bar contact sections.

Referring to FIG. 15 and FIGS. 13 and 14, second housing portion is seen to contain female inserts 274 beneath second contact sections 254 at second ends of bus bars 250,250A as in connector 100, having a pair of threaded holes aligned with post-receiving holes 258. Similarly, second housing portion 208 also extends through holes 262 of the bus bars to be secured mechanically thereto. A peripheral seal member 270 is again secured in a groove 238 in bulkhead proximate surface 234 of substrate 230 at transverse mounting portion 232. In first housing portion or member 204, a transverse mounting flange 226 includes a groove in which a second seal member 270A is disposed to define a seal when compressed against bulkhead surface 14.

Figure 17:
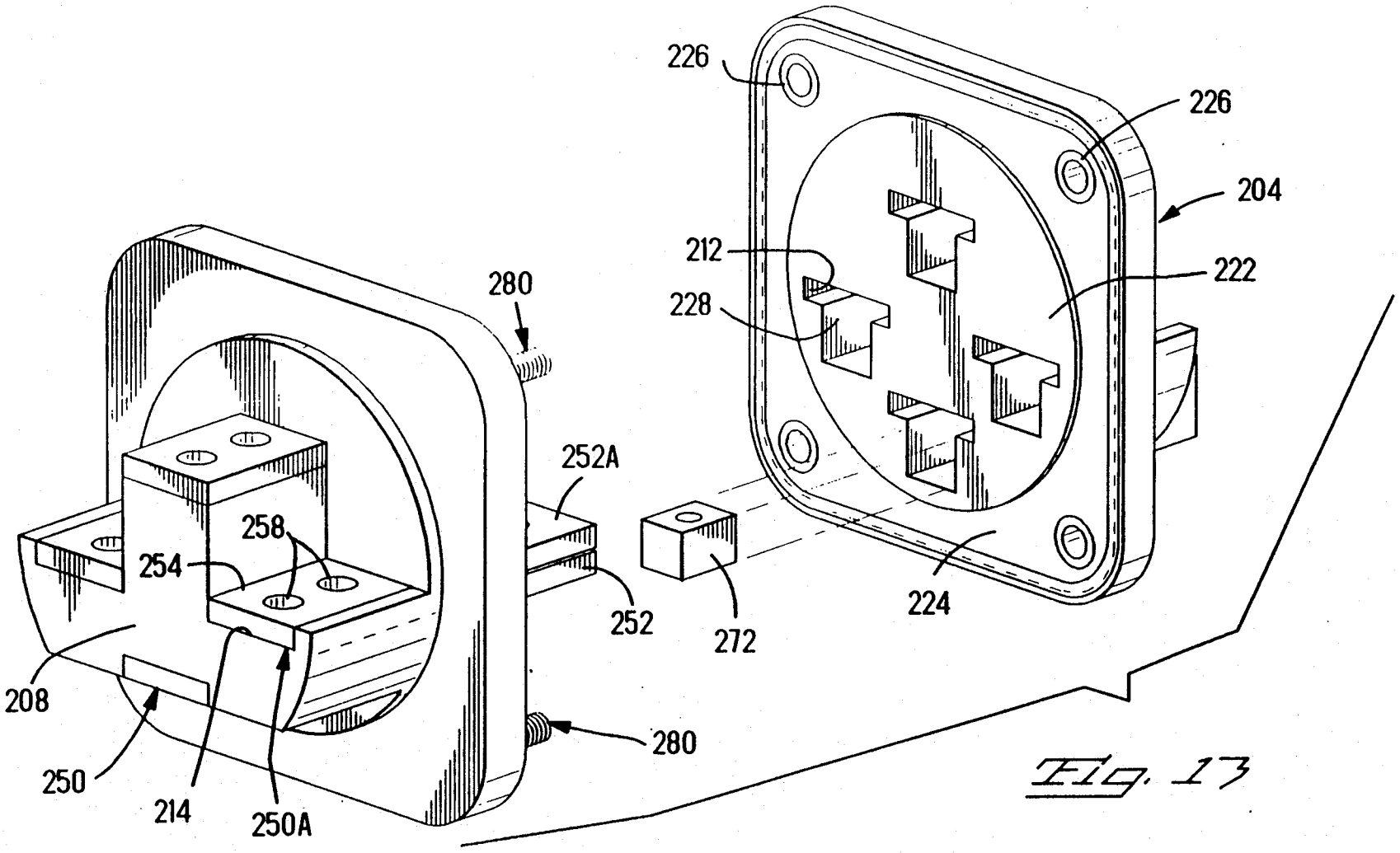
FIGS. 16 and 17 are shipside and engine side isometric views respectively of the embedded substrate with bus bars extending through respective openings prior to molding.
Figure 16:
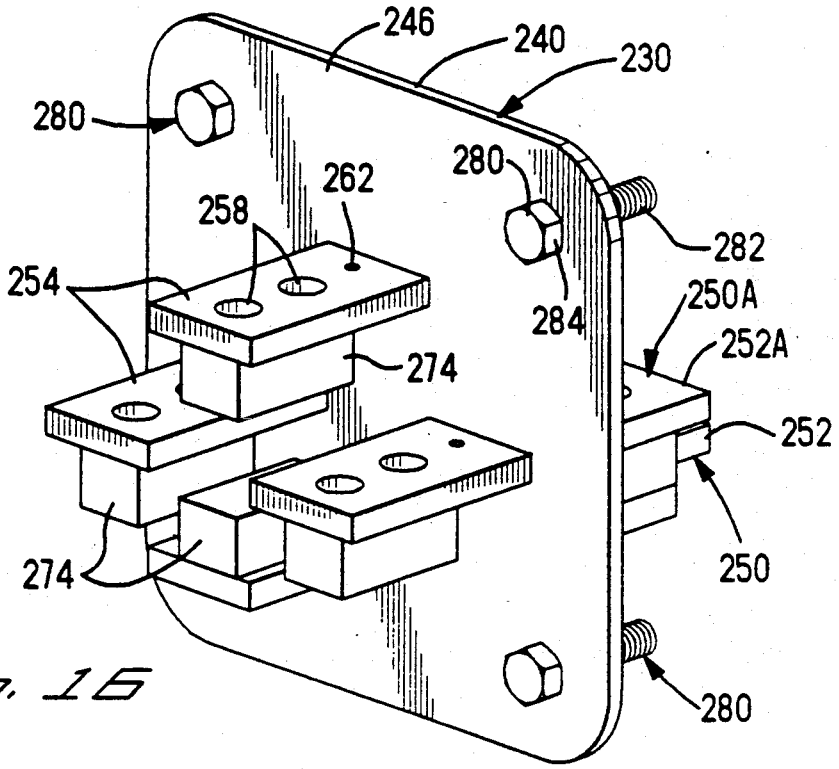
Figure 17:
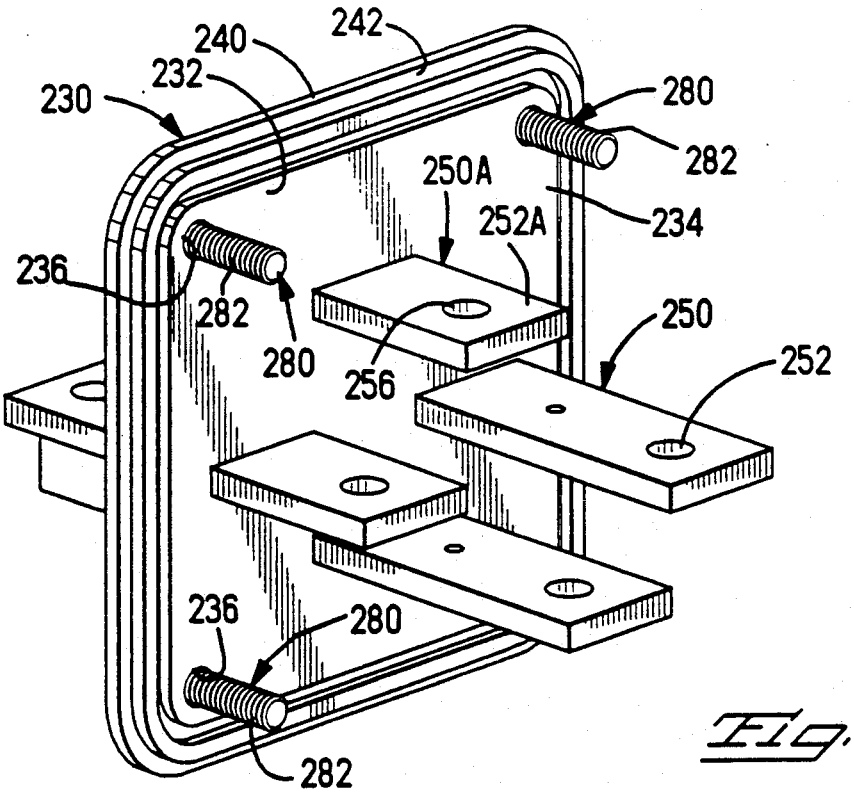

First housing member 204 also includes molded therein bushings 226 located to align with mounting openings 18 through bulkhead 10, to define mounting apertures for receipt of mounting bolts 280. To facilitate mounting of connector 200 to bulkhead 10 it is preferred that mounting bolts 280 be integrally fastened to second housing portion 208; FIGS. 15 to 17 show that bolts 280 may be insert molded to second housing portion 208 by being inserted through mounting apertures 236 of substrate 230, with heads 284 along the bulkhead remote surface 246 and shanks extending outwardly from bulkhead proximate surface 234. Second housing portion 208 is then molded over heads 284 of mounting bolts 280, which preferably are of hexagonal shape or are otherwise adapted to resist being rotated when nuts 286 are threaded onto shanks 282 during connector mounting. Bushings 226 enable nuts 286 to be threaded onto shanks 282 until tightly against bushings 226, assuring appropriate mounting, and also assuring that the substrate will remain positioned across bulkhead opening 12 should first housing member 204 disintegrate or incinerate.

Figure 18:
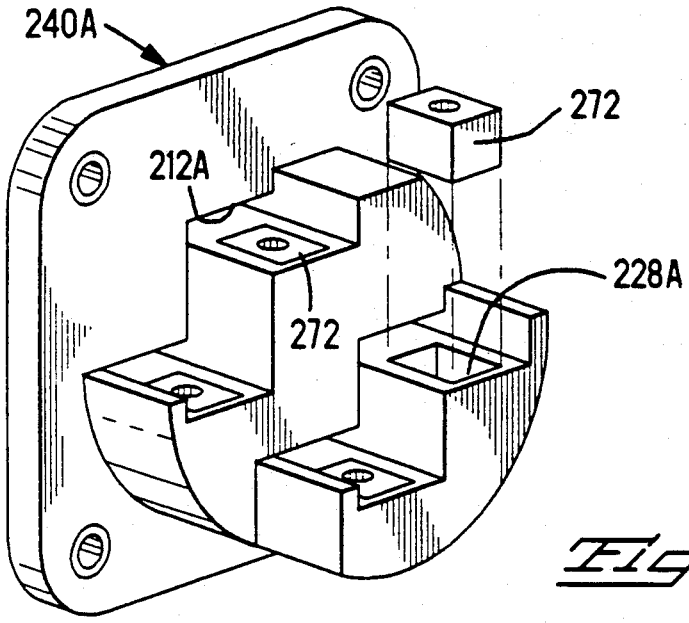
FIG. 18 is an isometric view of the first housing member showing an alternative method of placement of the female inserts into respective channels beneath bus bar locations, and the first housing member configured accordingly.

FIGS. 13 and 15 illustrate that female inserts 272 are insertable and bonded into first housing member 204 to be positioned beneath first contact sections 252,252A of bus bars 250,250A, by being slid axially into pockets 228 extending inwardly into housing portion 222 from the substrate proximate surface thereof to be placed in bulkhead opening 12 and against substrate 230, with pockets 228 being directly beneath bus bar channels 212. An alternate manner of assembly is shown in FIG. 18 wherein female inserts 272 are dropped into pockets 228A beneath channels 212A of housing 204A, wherein they are bonded.

Regarding both embodiments of connectors 100,200 for resistance to high temperatures, their substrates 130,230 are preferably produced of sintered polybenzimidazole resin, such as CELAZOLE U-60 sold by Hoechst Celanese Corp. of Houston, Tx. which is engineering plastic of high cost and which is molded under very high pressure into sheet form, then sintered under very high temperature, and later machined to shape. Bus bars 150,250 are preferably low resistance metal such as Alloy No. C-110 having high copper content. Terminal bolts or posts 28,38 are preferably made of high temperature stainless steel alloy such as No. A-286, and female inserts 172,174;272,274 may be high tensile of heat treated alloy steel nuts. Mounting bolts 180,280; nuts 186,286 and bushings 226 may be of stainless steel alloy as are commercially available. Terminals 24,34 having apertured tongues are commercially available and may be for example 0-3 or 0-4 gage ring tongue terminals of Alloy No. C-110 sold by AMP Incorporated, Harrisburg, Pa. The connector housings 102;202,204 may all be molded of high temperature resistant resin such as a thermoset polyester. Seals 170;270,272 may be high temperature resistant and fire resistant material such as fluorosilicone elastomer.

Alternatively, such a substrate may be made of stainless steel such as ASTM 303; the bus bars extend through substrate openings which are dimensioned larger than the bus bars to permit dielectric material to be molded or otherwise secured to establish insulation of the steel substrate from each bus bar. Optionally a metal clip can be secured to each bus bar spaced axially from the steel substrate on the engine side, having a transverse flange to shield the dielectric filled opening for enhanced flame protection.

The present invention provides an integral fire stopping means within the connector, which provides a barrier closing the bulkhead opening in which the connector is mounted, to protect the ship side of the bulkhead from flame in the event of a fire on the engine side. The fire stopping means has been shown in two embodiments for mounting from either side of the bulkhead and remains secured to the bulkhead by fastening means which remain intact without reliance on the plastic material of the housing of the connector. The connector is particularly suited for interconnection of power cables in a high temperature in-service environment.

Other variations and modifications may occur which are in the spirit of the invention and the scope of the claims. The bulkhead connector of the present invention may be used for electrical connections through bulkheads in other structures such as ships or buildings, wherein fire hazards are of particular concern. The contact sections of the bus bars could be formed into other configurations suitable to being electrically connected with other types of complementary terminals.

We claim:

1. An electrical connector adapted for bulkhead mounting, for extending through a bulkhead opening and interconnecting associated cables on opposed sides of a bulkhead, comprising:

at least one bus bar having a body section extending between first and second contact sections at first and second ends thereof;

first and second housing portions adjacent said first and second ends of said at least one bus bar and insulatively surrounding said body section thereof while at least exposing said first and second contact sections of each said bus bar for electrical connection to complementary electrical connecting means, at least one of said first and second housing portions including a mounting portion adapted to coextend along a surface of said bulkhead peripherally surrounding said bulkhead opening; and a transverse substrate embedded within at least one of said first and second housing portions shaped and dimensioned to include a transverse flange within said housing mounting portion and having a transverse bulkhead proximate surface thereof exposed to coextend along a surface of said bulkhead peripherally surrounding said bulkhead opening;

said substrate including at least one bar-receiving aperture axially therethrough for each said bus bar to extend therethrough, and said transverse flange and said housing mounting portion including a plurality of mounting apertures for mounting bolts to extend therethrough for connector mounting to said bulkhead.

2. The electrical connector as set forth in claim 1 wherein said substrate comprises flame resistant material.

3. The electrical connector as set forth in claim 2 wherein said substrate comprises sintered polybenzimidazole resin.

4. The electrical connector as set forth in claim 2 wherein said substrate comprises steel.

5. The electrical connector as set forth in claim 1 wherein each said bar-receiving aperture through said substrate is slightly larger than the cross-section of said body section of said bus bar extending therethrough.

6. The electrical connector as set forth in claim 1 wherein said bulkhead proximate surface of said substrate includes a seal member secured in a groove thereof surrounding said mounting apertures in said transverse flange, to define a seal with adjacent surface portions of said bulkhead upon connector mounting.

7. The electrical connector as set forth in claim 1 wherein said first housing portion includes said mounting portion and said substrate is embedded therewithin, and said second housing portion is joined to said body section of each said bus bar to extend outwardly from a central region of said bulkhead proximate surface of said substrate and having a substrate adjacent portion shaped and dimensioned to be inserted through said bulkhead opening from one side thereof.

8. The electrical connector as set forth in claim 7 wherein said first housing portion and said second housing portion each include a joint extending through a hole through said body section of each said bus bar.

9. The electrical connector as set forth in claim 7 wherein said housing mounting portion includes a mounting aperture extending to said substrate and aligned with each said substrate mounting aperture and being large enough for a head of a respective mounting fastener to be received thereinto to abut said substrate upon mounting said connector to said bulkhead.

10. The electrical connector as set forth in claim 7 wherein said first and second housing portions each underlie said first and second contact sections of each said bus bar respectively and include female inserts thereunder and thereagainst having threaded apertures thereinto aligned with bolt-receiving holes through said first and second contact sections, enabling ring terminals to be secured and electrically connected to said first and second contact sections by terminal bolts extending through holes in said ring terminals and through said bolt-receiving holes and threaded into said threaded apertures of said female inserts, said female inserts thus being held by said first and second housing portions against rotation.

11. The electrical connector as set forth in claim 10 wherein said second contact sections and said female inserts associated therewith include a pair of said bolt-receiving holes and threaded apertures respectively, for receipt of two said terminal bolts through two said holes in ring terminals being secured to said second contact sections, securing said ring terminals against rotation under torque after assembly.

12. The electrical connector as set forth in claim 10 wherein at least one of said female inserts includes an annular collar extending above a contact-proximate surface thereof adapted to be force fit into a counterbore of an associated said contact section for one of said first and second housing portions to be molded therearound, embedding said female insert therewithin.

13. The electrical connector as set forth in claim 10 wherein a contact-proximate surface of at least one said female insert is bonded to an associated said contact section for one of said first and second housing portions to be molded therearound, embedding said female insert therewithin.

14. The electrical connector as set forth in claim 7 wherein said first housing portion includes a vertical wall portion beside each said first contact section and extending upwardly thereof, defining a stop surface securing ones of said ring terminals secured to said first contact sections against rotation under torque after assembly.

15. The electrical connector as set forth in claim 1 wherein said second housing portion includes said mounting portion, and said substrate is embedded within said second housing portion in a manner exposing said bulkhead proximate surface with each said bus bar extending outwardly thereof, and said first housing portion is molded as a discrete member having a bus bar receiving channel associated with each said bus bar extending into a substrate-proximate surface thereof, and further including a mounting flange portion opposing said mounting portion of said second housing portion and having a corresponding plurality of mounting apertures therethrough.

16. The electrical connector as set forth in claim 15 wherein each said corresponding mounting aperture is defined by a bushing embedded in said mounting flange portion of said first housing portion, adapted to receive an end of an associated said fastening means therethrough during mounting.

17. The electrical connector as set forth in claim 16 wherein each said fastening means includes a head portion with a threaded shank extending through an associated said mounting aperture through said substrate, to extend through an associated said mounting hole through said bulkhead and through a respective said bushing of said first housing portion, for a complementary fastening means to be secured tightly thereonto thereby mounting said first and second housing portions to said bulkhead, defining said connector.

18. The electrical connector as set forth in claim 15 wherein an insert-receiving pocket is defined in said first housing portion beneath each said bus bar receiving channel, to each receive a female insert secured therein having a threaded aperture thereinto aligned with bolt-receiving holes through said first contact section of each said at least one bus bar, enabling a ring terminal to be secured and electrically connected to each said first contact section by a terminal bolt extending through a hole in said ring terminal and through a bolt-receiving hole of said first contact section and threaded into said threaded aperture of said female insert, said female insert thus being held by said first housing portion against rotation.

19. The electrical connector as set forth in claim 18 wherein said pocket extends axially to said substrate proximate surface of said first housing portion for a respective said female insert to be inserted thereinto from said substrate proximate surface.

20. The electrical connector as set forth in claim 15 wherein a seal member is secured in a groove in a bulkhead proximate surface of said mounting flange portion of said first housing portion outside of said mounting apertures, to engage an adjacent surface of said bulkhead for sealing thereagainst.

* * * * *

UNITED STATES PATENT AND TRADEMARK OFFICE

CERTIFICATE OF CORRECTION

PATENT NO. : 5,197,903

DATED : March 30, 1993

INVENTOR(S) : Daniel T. Casey et al

It is certified that error appears in the above-identified patent and that said Letters Patent is hereby corrected as shown below:

On the title page, Item [57]
In the Abstract:

In line 5, after "substrate (", delete "b".

In claim 17, column 10, line 2, after "head", add ---embedded in said mounting portion of said second housing---

Signed and Sealed this

Seventh Day of December, 1993

*Attest:*

*Attesting Officer*

Bruce Lehman

BRUCE LEHMAN

*Commissioner of Patents and Trademarks*